United States Patent [19]

Feuling

[11] Patent Number: 4,620,510

[45] Date of Patent: Nov. 4, 1986

[54] APPARATUS AND METHOD FOR IMPROVING THE EFFICIENCY OF INTERNAL COMBUSTION ENGINES AND FLUID PUMPING DEVICES

[76] Inventor: James J. Feuling, 686 Ash Ave., Chula Vista, Calif. 92010

[21] Appl. No.: 544,738

[22] Filed: Oct. 24, 1983

[51] Int. Cl.[4] ..... F01L 1/08

[52] U.S. Cl. ..... 123/90.6; 123/590; 60/312

[58] Field of Search ..... 123/90.6, 90.16, 90.17, 123/320, 590; 60/312

[56] References Cited

U.S. PATENT DOCUMENTS

| | | | |
|---|---|---|---|
| 2,344,993 | 3/1944 | Lysholm | 123/90.6 X |
| 2,644,436 | 7/1953 | Berlyn | 123/90.6 X |
| 3,451,213 | 6/1969 | Lang | 123/90.6 X |
| 3,574,304 | 4/1971 | Santi | 123/90.6 X |
| 3,834,364 | 9/1974 | Bartholomew | 123/590 X |
| 4,149,378 | 4/1979 | Nakamura et al. | 60/312 X |
| 4,211,199 | 7/1980 | Thatcher et al. | 123/590 X |

FOREIGN PATENT DOCUMENTS

| | | | |
|---|---|---|---|
| 140417 | 12/1978 | Japan | 123/590 |
| 108121 | 8/1979 | Japan | 60/312 |
| 1456025 | 11/1976 | United Kingdom | 60/312 |

*Primary Examiner*—William R. Cline
*Assistant Examiner*—Peggy A. Neils
*Attorney, Agent, or Firm*—Frank D. Gilliam

[57] ABSTRACT

This invention is directed to a novel camshaft for engine timing. The cam positions of the camshaft include secondary lobes in conjunction with normal primary lobes. The second lobes are positioned so that they precede their associated primary lobe during camshaft rotation. The secondary lobes cause an associated valve to open slightly and close completely prior to the normally expected valve opening caused by the primary lobe. This slight opening and closing creates a shock wave that aids the atomizing air and fuel mixing in the intake system prior to normal intake valve opening and enhances the scavenging of combustion gases during the exhaust cycle.

20 Claims, 10 Drawing Figures

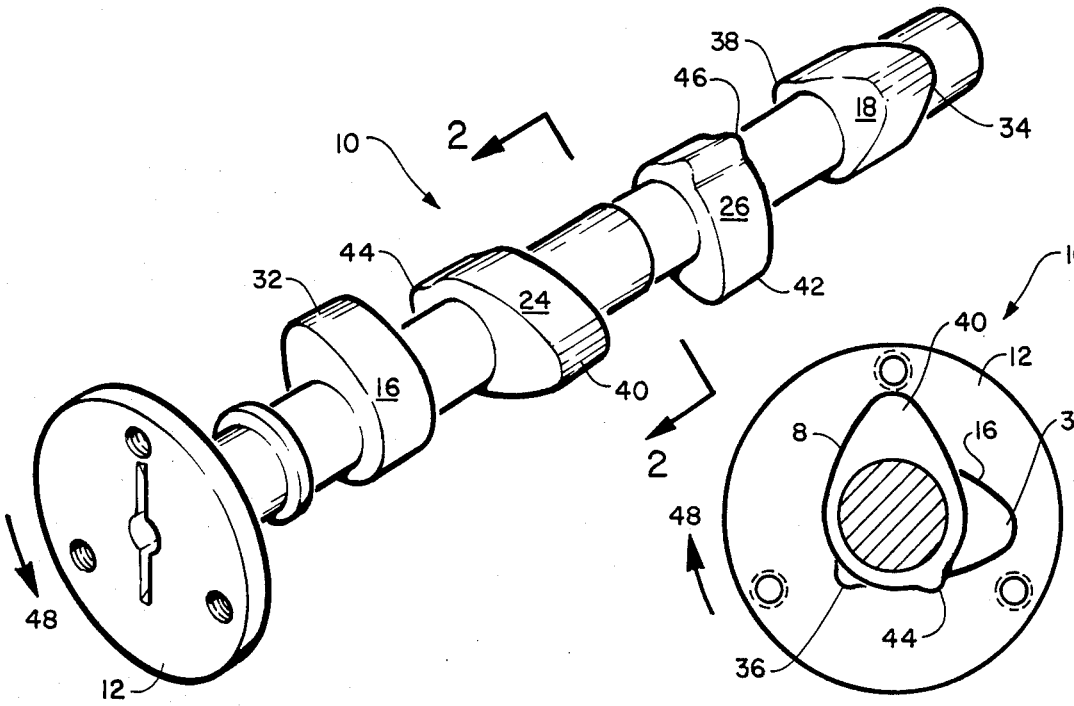
FIG. 1
FIG. 2
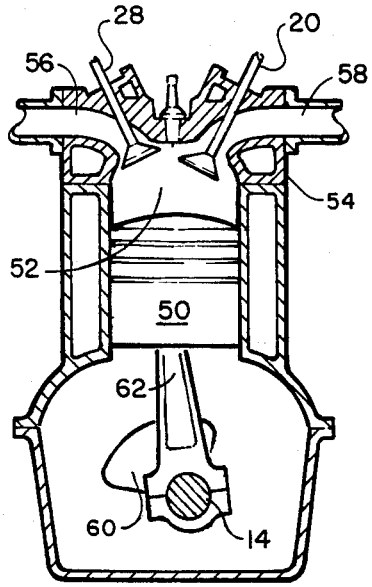
FIG. 3A
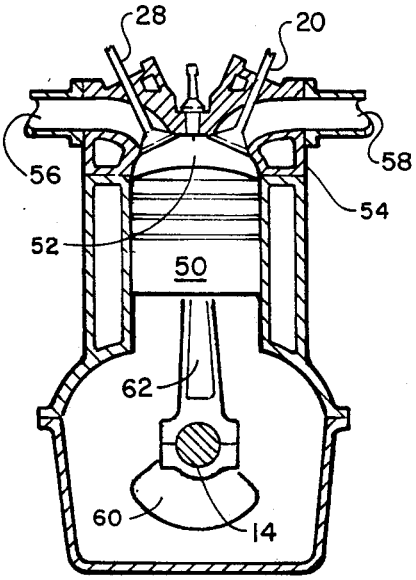
FIG. 3B
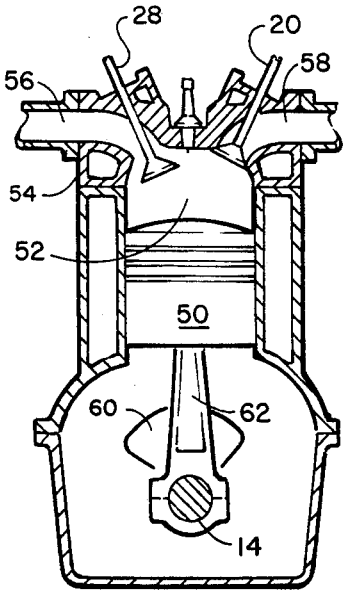
FIG. 3C

APPARATUS AND METHOD FOR IMPROVING THE EFFICIENCY OF INTERNAL COMBUSTION ENGINES AND FLUID PUMPING DEVICES

BACKGROUND OF THE INVENTION

This invention relates generally to intake and exhaust systems and more particularly to the effective use of shock wave phenomenon to improve the efficiency of an internal combustion engine or a like fluid pumping device having valved intake and exhaust functions.

In, for example, a four-stroke engine, on the first stroke the piston sucks in the fuel and air mixture, on the second stroke the piston compresses the fuel and air mixture, on the third stroke mixture is ignited near the top of the piston travel, causing the piston to be forced downward thereby supplying useful power, and the forth stroke wherein the piston forces the exhaust gases from the cylinder and then the four strokes are sequentially repeated. When the intake valve first opens under normal conditions a negative shock wave is created which draws the air and fuel into the cylinder. When the exhaust valve normally opens a positive shock wave immediately travels through the gases at a speed of 18,500 inches per second (the speed of sound at sea level). When the exhaust shock wave reaches the end of the exhaust system or pipe, a negative shock wave is created and that negative shock wave travels back through the outcoming gases at the same speed as the positive wave. Ideally, this negative shock wave which creates a slight vacuum will reach the exhaust valve prior to its normal closing sequence so that the slight vacuum is present to aid in extracting combustion products from the cylinder.

To utilize the shock wave phenomenon, tuned exhaust systems have been designed. Tuned exhaust systems are length sensitive, that is for a certain engine r.p.m. desired, a specific exhaust system length is required. This length (1) is determined from the following equation:

$$\frac{\text{exhaust time in °}}{\text{one revolution (360°)}} \times \frac{\text{60 seconds}}{\text{r.p.m.}} \times \frac{\text{18,500 inch/sec}}{4(K)} = 1$$

Applying the equation to a given engine with a desired operating speed of 6,000 r.p.m., and with cam timing which holds the exhaust valve open for 298° of engine rotation (the exhaust valve opens at 78° before the piston reaching bottom dead center (BBDC) the following tuned exhaust system length for that r.p.m. results:

$$\frac{\text{298° exhaust}}{\text{360°}} \times \frac{\text{60 sec}}{\text{6,000}} \times \frac{\text{18,500 inch/sec.}}{4} = \text{38.2 inches}$$

As can be seen, if the exhaust length, in the example, is 38.2 inches in length the negative shock wave will normally reach the exhaust port prior to normal exhaust valve closure and engine efficiency will be increased; however, most engines operate through a wide range of r.p.ms, therefore, the engine will have decreased efficiency below or above the ideal engine speed of 6,000 r.p.m.

A number of years ago an attempt was made by Ed Iskenderian Racing Cams of Inglewood, Calif. to add a third lobe to a conventional two lobe cam for use in a super charged racing engine to purge cool the engine by opening the intake valve at 2.5° after bottom dead center (abdc) during the exhaust stroke (after initial blow down when peak pressure is reduced) and holding the valve open for approximately 55° whereby supercharged air from the intake track (at a higher pressure than the exhaust gases) forced the hot exhaust gases from the engine. This attempt to lower engine temperature to prevent pre-ignition was abandoned during dyno testing do to the device being inoperative for the purpose for which it was intended.

It has been found in intake systems that engine volumetric efficiency and power can be increased by taking advantage of the natural dynamic effects which occur during the intake cycle. When the intake valve closes a sonic pressure wave bounces back out the intake track, and then in again toward the valve. By making the intake track the proper length, the returning pressure wave can be timed to arrive at top dead center of the next intake cycle, shoving extra air in and keeping exhaust gases out of the intake port. To use this pulse, the intake port must be the correct length. The pulse will help only through a narrow range of rpm. Above or below a certain range the pulse will actually decrease power so proper synchronization is essential. There are actually several pulses which can be used, corresponding to the 2nd, 3rd and 4th time the sonic wave harmonic arrives at the valve. The 2nd harmonic is the most efficient, the others being weaker and shorter. To obtain the inlet system length, the desired operating rpm (peak) is established, for example; 8,000, and that number is divided into an established length formula number which is 132,000/rpm for the 2nd harmonic, 97,000/rpm for the 3rd harmonic, 74,000/rpm for the 4th harmonic etc. . . This would result in an intake track length of 16.5 inches for the 2nd harmonic, 12.125 inches, and for the 4th harmonic 9.25 inches. In addition to obtain the desired benefit from this negative shock wave phenomenon, it is also necessary that the intake valve open to a lift height of at least 0.02 times the valve diameter by 15° before top dead center (bfdc) while openings of 20° to 40° bfdc are usually preferable and the intake flow rating must be 0.3 or greater for significant benefits.

There is a continuing need to improve the removal of gases of combustion and improved the fuel efficiency of internal combustion engines and the like.

SUMMARY OF THE INVENTION

According to the invention, a separate shock wave is introduced into both the exhaust and intake systems of an internal combustion engine or the like prior to its respective normal valve opening. Thus, in the intake system, a positive shock wave is introduced prior to the normal intake valve opening which blasts any fuel droplets remaining on the underside of the intake valve or adjacent intake manifold walls deposited from a prior fuel air charge, causing these fuel droplets to be substantially atomized prior to the subsequent sucking in of the new fuel air mixture by intake valve opening during the normal intake stroke. In the exhaust system, the positive shock wave travels the length of the exhaust system and returns as a negative wave (slight vacuum). This negative wave is timed to return during the normal exhaust valve open sequence. There is no second shock wave upon the normal opening of the intake valve, but merely the normal sucking force expected. However, the normal opening of the exhaust valve produces the normally expected positive shock wave discussed hereinbefore in the background. The combination of the first shock wave and second shock wave in the exhaust system have the effect of providing a range of engine r.p.ms for a given tuned exhaust system. The first and second shock wave insures that a negative wave will be present during the duration of the exhaust valve opening within a range of engine r.p.ms.

An object of this invention is to provide a more efficient fuel to air mixture available to be drawn into the engine.

Another object of this invention is to provide increased overall engine efficiency.

Still another object of this invention is to increase the output horsepower of a given engine.

A still further object of the invention is to provide a first negative shock wave which combines in with the second normal shock wave to increase the engines efficiency over a wide range of engine speeds.

These and other objects and features of the invention will become more clearly apparent upon a review of the following description in conjunction with the accompanying drawings.

BRIEF DESCRIPTION OF THE DRAWINGS

FIG. 1 is a perspective showing of a camshaft for a four cylinder engine showing the primary and secondary lobes associated with each valve;

FIG. 2 is a view of FIG. 1 taken along line 2—2;

FIG. 3A–3G are schematic showings of the position of the intake and exhaust valves during operation of an engine incorporating the present invention.

DETAILED DESCRIPTION OF THE PREFERRED EMBODIMENT

Figure 3D:
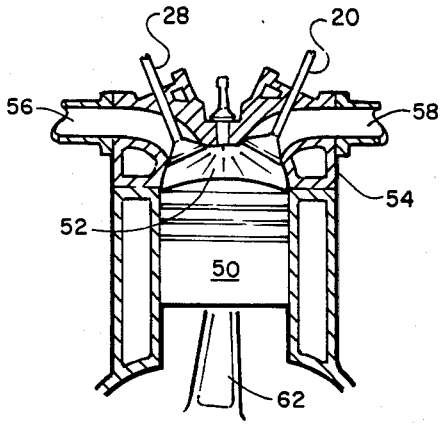

The same reference numerals are used throughout the specifications and drawings to depict the same or similar element or part.

Referring in detail to the drawings figures, the numeral 10 indicates a typical timing camshaft for a four cylinder internal combustion engine, operating a pair of valves from each cam position, chosen for ease of explanation of the invention, a typical engine of this type includes an intake and exhaust valve for controlling the intake of fuel and air and the exhausting of gases of combustion of each cylinder. The particular camshaft 10 shown includes a front disk 12 which carries a timing gear, (not shown), for engaging a gear or chain (not shown) driven by the engine crank shaft 14 in a conventional and known manner.

The camshaft 10 comprises four cam there is a cam for each valve. Cams 16 and 18, located on each end of the camshaft 10, operate the two exhaust valves 20, while cam locations 24 and 26 operate two intake valves 28. Cam locations 16 and 18 each includes a principle lobe 32 and 34 and a secondary or minor lobe 36 and 38 respectively and cam locations 24 and 26 each include a similar principle lobe 40 and 42 and secondary or minor lobe 44 and 46 respectively. The normal operations of the camshaft 10 is in a counter-clockwise direction along arrow 48. It should be understood that the direction of the cam rotation is important only in respect to the placement of the secondary lobes relative to the principle lobes, ie., the secondary or minor lobes must precede its associated principle lobe in operation.

As can be seen in FIGS. 1 and 2, the secondary lobe associated with each cam location must not be positioned on its associated principle lobe or so closely adjacent that it does not operate its associated valve independent of the principle lobe, ie., there must be two separate and independent valve actions one caused by the secondary or minor lobe and one caused by the principle lobe. The spacing between the principle lobe and secondary or minor lobe is calculated by the expected engine r.p.m., ie., the wider the expected engine r.p.m. range, the further the spacing between the two adjacent lobes.

Referring now to FIGS. 3A–3G, the various cycles of a four cylinder engine are shown. It should be understood that this invention is not limited to four stroke cycle engines and could be employed equally as well on two stroke cycle engines or any other type of device utilizing intake and/or exhaust valve means for controlling fluid flow therebetween.

FIG. 3A depicts a schematic showing of an engine with a lower engine housing encasing the crank shaft with balancing web 60 and an upper engine cylinder 52 with attached head 54 with intake and exhaust conduits 56 and 58 respectfully, and valves 20 and 28 and a connecting rod 62 between crank shaft 14 and piston 50. FIGS. 3B–3F are a portion of FIG. 3A showing the position of various engine components of various engine cycle positions.

In FIG. 3A, intake valve is shown in a partially open condition caused by the secondary or minor lobe of its cam position, ie., it is partially opened by, as for example, secondary or minor lobe 44. The secondary or minor lobe is not required to open its associated valve to any great degree. It must, however, open the valve sufficiently to initiate a shock wave which is associated with valve openings. The duration of valve openings is determined by lobe width. It has been determined that this width can be extremely small, but must be wide enough to cause a definite partial valve opening and re-seating of the valve prior to the normal valve activation by the principle lobe associated therewith. The exhaust valve is shown in its normally open position as is expected during the exhaust cycle. According to FIG. 4, the opening of the intake valve by the secondary or minor lobe is simultaneously with or slightly after the opening of the exhaust valve by the principal lobe associated therewith. The exhaust pressure being at or near peak pressure enhances the amplitude of the shock wave created in the intake conduit.

FIG. 3B depicts the intake and exhaust valve closed prior to the normal intake cycle.

FIG. 3C depicts the intake valve open and the exhaust valve closed during the intake cycle.

FIG. 3D depicts both the intake and exhaust valves remaining closed during the power cycle.

Figure 3E:
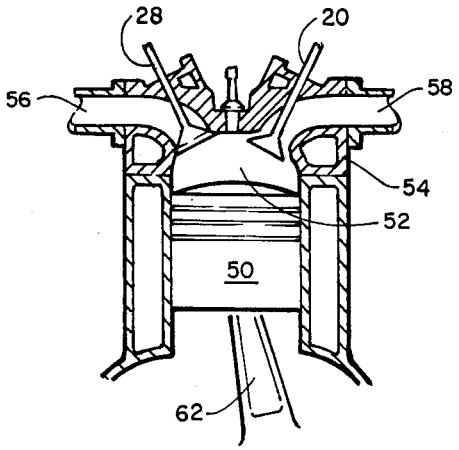

FIG. 3E depicts the intake valve closed and the exhaust valve partially open due to activation by secondary or minor lobe, for example, lobe 36. The secondary or minor lobe spacing from the principle lobe as well as lift is as discussed above for the exhaust secondary or minor lobe.

Figure 3F:
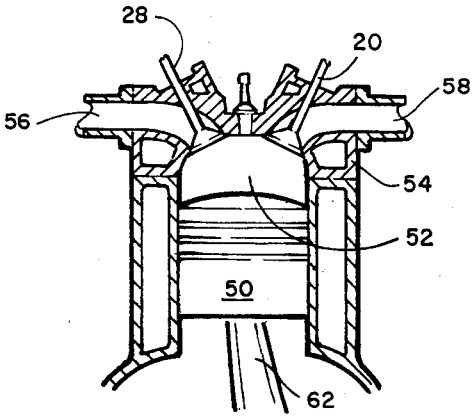

FIG. 3F depicts both valves closed after the partial exhaust valve opening sequence.

Figure 3G:
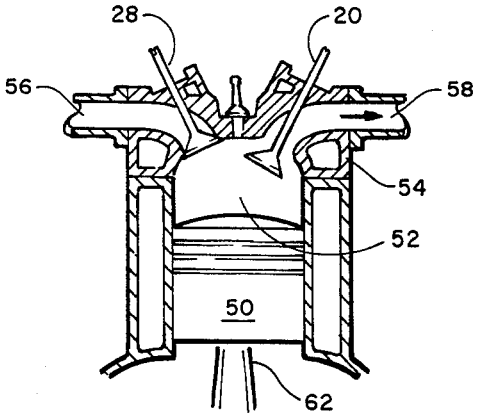

FIG. 3G depicts the intake valve closed and the exhaust valve in an open position during the normal exhaust cycle.

OPERATION OF THE INVENTION

It is known that during the intake cycle depicted in FIG. 3C that the fuel and air mixture from the intake manifold rush into the cylinder 48 because of the suction created therein by the down stroke of the piston 50. It is also known that when the intake valve 28 closes as shown in FIG. 3D, that the closing off of the moving fuel and air stream into the cylinder by the intake valve closure causes fuel droplets to accumulate on the underside of the valve, the valve stem and adjacent intake manifold surface areas. When the intake valve is reopened on the next intake cycle (as in FIG. 3C) these droplets of fuel are ingested into the cylinder 48 along with the fuel and air stream. This excess fuel from the droplets create a richer than desired engine mixture as well as nonuniformity of fuel/air mixture, which results in inefficiency, unwanted hydrocarbons and the like. The use of a secondary of minor lobe (44 and 46) on the intake valve camshaft location causes a positive shock wave to be created in the intake manifold due to the fact that the secondary or minor lobe is positioned to slightly open and close the intake valve during or near initiation of the exhaust cycle and prior to actual normal intake valve opening. The exhaust pressure shock wave is abruptly released into the intake manifold causing the fuel droplets collected therein to atomize prior to the normal intake valve opening. This results in a substantially vaporized fuel/air charge into the cylinder. The end result is a clean burn of fuel and air and increased engine efficiency.

The operation of the opening and closing of the exhaust valve by the secondary or minor lobe related thereto to (FIG. 3E) causes a positive shock wave to be initiated at the exhaust valve port which travels the length of the exhaust system (not shown) and returns to the exhaust valve port as negative shock wave (partial vacuum) while the exhaust valve is in an open condition and thereby assists in removing the gases of combustion from the cylinder.

The normal opening of the exhaust valve creates a second positive shock wave which acts in the same manner as the first positive shock wave. The first negative wave created by the secondary or minor lobe valve opening is timed to return during normal exhaust valve open condition even under maximum r.p.m. The second negative shock wave operates in a known and expected manner; however, it may not be present while the exhaust valve is open under some high r.p.m. conditions. In some instances only the second shock wave will be present and in other instances both shock waves will be present during normal exhaust valve open conditions. Which shock wave is present is determined by exhaust system length engine speed, and lobe separation.

The overall effect is the use of the negative pressure wave advantageously during high and intermittent engine r.p.ms rather than at substantially a single engine speed.

The overall result is improved engine performance, reduced fuel consumption and cleaner fuel burn.

It should be understood that the shock wave phenomenon can be utilized in any fluid flow system where fluid is drawn into and pumped from a chamber where the flow is controlled by valve opening and closure.

It should be further understood that the positive shock wave can be created by an means in addition to the cam operated valve opening. By way of example, and not by way of limitation, additional means for creating the shock wave may include rotary valves, solenoid activated valves, mechanical impact to the appropriate location, or any other means for creating a mechanical shock at a location which will create a sonic wave that will act in the same manner as the cam operated valve opening sequence explained above.

Figure 4:
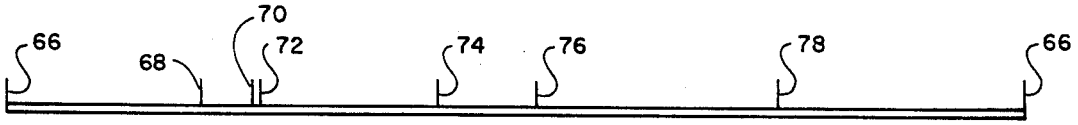
FIG. 4 is a schematic showing of valve opening sequence and sonic shock initiation related thereto.

FIG. 4 depicts a timing sequence for a typical four stroke cycle engine incorporating the invention. At the extreme left side of the FIG. 4, event 66 designates the beginning of the power cycle. During the last one half of the power cycle indicated at event 68, a sonic wave is initiated in the exhaust system closely adjacent the engine exhaust port. The exhaust cycle begins at event 70, that is the exhaust valve opens and a second shock wave is initiated in the exhaust system. Simultaneously or very shortly thereafter within the first one quarter of the exhaust cycle, a sonic wave at event 72 is initiated in the intake system closely adjacent the intake valve, at event 74 the intake valve commences to open, at event 76 the exhaust valve closes and at event 78 the intake valve closes. The engine then proceeds through the compression cycle between events 78 and 66 and the power cycles between 66 and 70 and repeats the cycles as shown and discussed. The sonic waves produced at events 68 and 70 return as negative waves to assist in combustion removal and the shock wave at time 72 operates as a positive wave to atomize the fuel clinging to the underside of the intake valve and adjacent manifold walls.

The invention having thus been described, what is claimed and desired to be secured by Letters Patent is as follows:

1. An improved method of scavenging exhaust gases from an internal combustion engine, following the power cycle said engine comprising at least one cylinder with intake and exhaust valve means and exhaust conduit means comprising the steps of:

creating a sonic shock wave in said exhaust conduit means intermediate the last one half of said power cycle prior to the normal opening of said exhaust valve means during a predetermined engine timing sequence;

opening said exhaust valve means according to its normal predetermined engine timing sequence; and producing a negative sonic shock wave from said sonic shock wave which reaches said exhaust valve means during its normal open condition.

2. The method as defined in claim 1 wherein said sonic shock wave is created by a first opening of said exhaust valve means prior to said opening of said exhaust valve means according to its normal predetermined engine timing sequence.

3. An improved method of mixing the incoming gases of combustion into the cylinder of an internal combustion engine and removing the combusted gases therefrom during an exhaust cycle, said engine having at least one cylinder with intake and exhaust valve means and an intake conduit means comprising the steps of:

creating a positive sonic shock wave in said intake conduit means during the first one quarter of said exhaust cycle prior to the opening of said intake valve means during a predetermined engine timing sequence; and opening said intake valve means according to its normal predetermined engine timing sequence, said positive sonic shock wave acting to atomize fuel remaining in said intake conduit means prior to the normal opening of the intake valve.

4. The method as defined in claim 3 wherein said sonic shock wave is created by a first opening and closing of said intake valve means prior to said opening of said intake valve means according to its normal predetermined engine timing sequence.

5. A method for improving the efficiency of an internal combustion engine having power and exhaust operational cycles at least one cylinder with intake and exhaust valve means and intake and exhaust conduit means comprising the steps of:

creating a first positive sonic shock wave in said intake conduit means during the first one quarter of said exhaust cycle prior to the normal opening of said intake valve means according to a predetermined engine timing sequence;

opening said intake valve means according to said predetermined engine timing sequence;

creating a second sonic shock wave in said exhaust conduit means during the last one half of said power cycle prior to the opening of said exhaust valve means according to a predetermined engine timing sequence; and opening said exhaust valve means according to said predetermined engine timing sequence;

said first sonic shock wave causes droplets of fuel collected in the intake conduit means to be atomized prior to the air and fuel mixture being pulled through said intake conduit into one of said at least one cylinder and a second negative sonic shock wave produced by said second sonic shock wave reaches said exhaust valve means during its normal predetermined opening, causing the gases of combustion to be aided in their removal from said cylinder into said exhaust conduit means.

6. The method as defined in claim 5 wherein said first sonic shock wave is created by an opening of said intake valve means prior to said opening of said intake valve means according to said normal predetermined engine timing sequence.

7. The method as defined in claim 5 wherein said second sonic shock wave is created by an opening of said exhaust valve means prior to said opening of said exhaust valve means according to said normal predetermined engine timing sequence.

8. The method as defined in claim 5 wherein said first sonic shock wave is created by an opening of said intake valve means prior to said opening of said intake valve means according to said normal predetermined engine timing sequence and said second sonic shock wave is created by an opening of said exhaust valve means prior to said opening of said exhaust valve means according to said normal predetermined engine timing sequence.

9. The method as defined in claim 5 wherein said first positive sonic shock wave is initiated substantially at the same time as the opening of said exhaust valve according to its predetermined engine timing sequence.

10. Means for improving the operating efficiency of an internal combustion engine having power and exhaust cycles comprising:

at least one cylinder;

intake and exhaust conduits;

intake and exhaust valve means associated with said cylinder and said conduits for controlling the flow of a fuel and air mixture into said cylinder and removal of the exhaust gases therefrom;

a timing means for operating said valve means at a predetermined time between open and closed positions; and means for creating a positive sonic shock wave in said exhaust conduit during the last one half of said power cycle prior to the normal opening of said exhaust valve by said timing means, whereby said positive sonic wave travels the length of the exhaust conduit and returns to said exhaust valve means as a negative shock wave during the time said timing means operates said exhaust valve in an open condition.

11. The invention as defined in claim 10 additionally comprises means for creating a positive sonic shock wave in said intake conduit means during the first one quarter of the exhaust cycle prior to the opening of said intake valve by said timing means, whereby said positive sonic wave travels in said intake conduit, thereby acting to atomize fuel remaining in said intake conduit.

12. The invention as defined in claim 10 wherein said timing means comprises a camshaft having separately positioned primary lobes for operating said intake and exhaust valve means at a predetermined time and the exhaust cam lobe includes a secondary lobe positioned adjacent thereto for operating said exhaust valve means during the last one half of the power cycle prior to operation by the primary lobe, whereby said positive sonic wave is created in said exhaust conduit.

13. The invention as defined in claim 12 wherein said primary lobe causes said exhaust valve means to open to a greater degree and stay open for a longer span of time than said secondary lobe.

14. The invention as defined in claim 11 wherein said timing means comprises a camshaft having separately positioned primary lobes for operating said intake and exhaust valve means at a predetermined time and the intake lobe includes a secondary lobe positioned adjacent thereto for opening and closing said intake valve means during the first one quarter of the exhaust cycle prior to opening and closing by said primary lobe, whereby said positive sonic wave is created in said intake conduit.

15. The invention as defined in claim 11 wherein said timing means comprises a camshaft having separately positioned primary lobes for operating said intake and exhaust valve means at a predetermined time and the exhaust and intake cam lobes include a secondary lobe positioned adjacent thereto for operating said exhaust and intake valve means during the last one half of the power cycle and the first one quarter of the exhaust cycle respectively prior to operation by the primary lobe, whereby said positive sonic waves are created in said exhaust and intake conduits.

16. The invention as defined in claim 15 wherein said primary lobes causes said valve means to open to a greater degree and stay open for a longer span of time than said secondary lobes.

17. Means for improving the operating efficiency of an internal combustion engine having at least one cylinder comprising:

intake and exhaust conduits;

intake and exhaust valve means associated with said at least one cylinder and said conduits for controlling the flow of a fuel and air mixture into said cylinder and removal of the exhaust gases therefrom;

a timing means for operating said valve means at a predetermined time between open and closed positions; and means for creating a positive sonic shock wave in said intake conduit prior to the normal opening of said intake valve means, whereby said positive sonic wave travels into the intake conduit acting to atomize fuel droplets therein and on the under side of said intake valve means.

18. The invention as defined in claim 16 wherein said timing means comprises a camshaft having separately positioned primary lobes for operating said intake and exhaust valve means at a predetermined time and the intake cam lobe includes a secondary lobe positioned adjacent thereto for operating said intake valve means open substantially simultaneously with the opening of the exhaust valve and then closing said intake valve prior to operation by the primary lobe, whereby said positive sonic wave is created in said intake conduit.

19. The invention as defined in claim 18 wherein said primary lobe causes said intake valve means to open to a greater degree and stay open for a longer span of time then said secondary lobe.

20. The invention as defined in claim 12 wherein a secondary lobe is associated with said intake primary lobe which operates said intake valve to partially open and then closes at a time slightly after said exhaust valve is opened by said primary lobe.

* * * * *